US009783993B2

(12) United States Patent
Gleeson et al.

(10) Patent No.: US 9,783,993 B2
(45) Date of Patent: Oct. 10, 2017

(54) ADJUSTABLE BUILDING PANEL SUPPORT DEVICE

(71) Applicant: James Hardie Technology Limited, Dublin (IE)

(72) Inventors: James A. Gleeson, Sydney (AU); Jeremy McCandless, Sydney (AU)

(73) Assignee: James Hardie Technology Limited, Dublin (IE)

( * ) Notice: Subject to any disclaimer, the term of this patent is extended or adjusted under 35 U.S.C. 154(b) by 0 days.

(21) Appl. No.: 15/344,399

(22) Filed: Nov. 4, 2016

(65) Prior Publication Data

US 2017/0130464 A1 May 11, 2017

(30) Foreign Application Priority Data

Nov. 6, 2015 (GB) ..... 1519669.4

(51) Int. Cl.
*E04B 1/74* (2006.01)
*E04F 13/08* (2006.01)
(Continued)

(52) U.S. Cl.
CPC ..... *E04F 13/0853* (2013.01); *E04B 1/40* (2013.01); *E04B 1/7629* (2013.01); *E04B 1/62* (2013.01);
(Continued)

(58) Field of Classification Search
CPC . E04B 1/62; E04B 1/40; E04B 1/7629; E04B 2001/405; E04F 13/0853; E04F 13/085; E04F 13/0855; E04F 13/086; E04F 13/081
USPC ..... 52/404.5, 745.12, 506.05, 506.06, 509, 52/510, 511, 512, 513, 385, 712, 713, 52/715, 698, 699, 126.1, 126.5, 126.7
See application file for complete search history.

(56) References Cited

U.S. PATENT DOCUMENTS 5,544,461 A * 8/1996 Sommerstein ..... E04F 13/0807 52/235
5,619,834 A * 4/1997 Chen ..... E04F 13/0855 52/126.1
(Continued)

FOREIGN PATENT DOCUMENTS

DE 4228338 A1 10/1993
ES 2 352 484 A1 2/2011
(Continued)

OTHER PUBLICATIONS

United Kingdom Intellectual Property Office Search Report for corresponding Great Britain Application No. GB 1519669.4, filed Nov. 6, 2015, dated Apr. 27, 2016, 6 pages.

*Primary Examiner* — Chi Q Nguyen
(74) *Attorney, Agent, or Firm* — Knobbe Martens Olson & Bear, LLP

(57) ABSTRACT

An adjustable building panel support device comprising a building panel support element, a support bracket and at least one connector suitable for attaching an insulated building panel to a substrate for constructing an insulated wall section. The building support element and the support bracket are fixable together at a user determinable position by the at least one connector whereby the distance between the building panel support element and the support bracket can be varied to accommodate surface variations that may be present on a substrate surface.

7 Claims, 8 Drawing Sheets

(51) Int. Cl.

| | |
|---|---|
| ***E04B 1/41*** | (2006.01) |
| ***E04B 1/76*** | (2006.01) |
| *E04B 1/62* | (2006.01) |
| *E04B 1/38* | (2006.01) |

(52) U.S. Cl.
CPC ..... *E04B 2001/405* (2013.01); *E04F 13/081* (2013.01); *E04F 13/085* (2013.01); *E04F 13/086* (2013.01); *E04F 13/0855* (2013.01)

(56) References Cited

U.S. PATENT DOCUMENTS

| | | | | |
|---|---|---|---|---|
| 5,657,593 | A | 8/1997 | Eriksen | |
| 5,956,910 | A * | 9/1999 | Sommerstein | E04F 13/081 52/235 |
| 6,098,364 | A * | 8/2000 | Liu | E04F 13/0855 52/235 |
| 8,468,765 | B1 * | 6/2013 | Kim | E04F 13/0835 52/235 |
| 8,806,838 | B2 * | 8/2014 | Shin | E04B 1/04 52/235 |
| 2003/0097807 | A1 | 5/2003 | Shidler | |
| 2015/0308098 | A1 * | 10/2015 | Tessadori | E04F 13/0807 52/698 |
| 2017/0130464 | A1 * | 5/2017 | Gleeson | E04B 1/40 |

FOREIGN PATENT DOCUMENTS

| | | | |
|---|---|---|---|
| FR | 2 550 815 | A1 | 2/1985 |
| WO | WO 2005/090706 | A1 | 9/2005 |
| WO | WO 2006/090195 | A1 | 8/2006 |
| WO | WO 2010/136737 | | 12/2010 |

* cited by examiner

ADJUSTABLE BUILDING PANEL SUPPORT DEVICE

REFERENCE TO RELATED APPLICATIONS

This application claims the benefit of United Kingdom Patent Application No. GB1519669.4, filed on Nov. 6, 2015, entitled "ADJUSTABLE BUILDING PANEL SUPPORT DEVICE," which is hereby incorporated by reference in its entirety and for all purposes.

BACKGROUND

Field

The disclosure relates generally to building construction and in particular to building panel support devices.

Description of the Related Art

Any discussion of the prior art throughout the specification should in no way be considered as an admission that such prior art is widely known or forms part of the common general knowledge in the field.

Techniques for constructing building sections, such as wall sections in new construction make assumptions that the substrate will generally be constructed at the same time, and that the substrate can be constructed generally in line with current building standards and will provide a suitable base for application of a cladding material according to a manufacturer's instructions.

Retrofitting a new cladding material onto a pre-existing substrate, such as an existing brick or masonry construction wall, is more difficult as the substrate surface may not be suitably flat or sufficiently regular to be able to adequately fix support battens to which a new cladding can be applied.

It is desirable to provide a building panel support device suitable for use on existing building substrates with an irregular surface.

SUMMARY

Accordingly, there is provided in various embodiments an adjustable building panel support device designed to facilitate installation of cladding and other wall sections to an existing substrate having surface profiles or other irregularities. In some embodiments, the device generally comprises a building panel support element, a support bracket and at least one connector, the building support element and the support bracket being fixable together at a user determinable position by at least one connector.

One advantage of an adjustable building panel support device disclosed herein is that the distance between the building panel support element and the support bracket can be varied, thereby accommodating surface variations that may be present on a substrate surface. Another advantage is that the device is configured to reduce the gap between adjacent wall sections which reduces the loss of thermal insulation performance. Yet another advantage is that the device substantially prevents moisture migration through the wall system.

In one embodiment, an insulated wall section is described. The insulated wall section comprises a building substrate, at least one adjustable building panel support device fixed to the substrate, and at least one insulated building panel. Each adjustable building panel support device comprises a support bracket fixed to the building substrate and a building panel support element comprising a plate section having a proximal portion and a distal end, a first support flange orthogonally intersecting the plate section at the distal end and configured to support and retain at least one building panel, and a second support flange orthogonally intersecting the plate section and configured to support and retain an insulating material. The second support flange intersects the plate section at a location spaced between the proximal portion and the distal end. The building panel support element is configured to be fixed to the support bracket at a user determined distance from the building substrate. Each insulated building panel comprises a wall panel comprising a first major surface, a second major surface parallel to the first major surface, and a pair of opposing edges, each opposing edge having a recess parallel to the first major surface and at least partially surrounding the first support flange, and an insulating material comprising a first face and a second face disposed at an angle relative to the first face, the first face being fixed to the second major surface of the wall panel, the second face having a support recess parallel to the first face and at least partially surrounding the second support flange.

The length of the first support flange in a direction orthogonal to the plate section can be less than the length of the second support flange in the direction orthogonal to the plate section. The length of the first support flange in a direction orthogonal to the plate section can be greater than the width between the first major surface and the second major surface of each wall panel. The support bracket can comprise a first planar portion fixed to the building substrate and a second planar portion extending at an angle from the first planar portion, the second planar portion configured to support the building panel support element. The building panel support element can comprise a combination of a polymer and a metal. The insulated wall section can further comprise a chemical adhesive layer disposed between the first face of the insulating material and the second major surface of the wall panel, wherein the first face of the insulating material is fixed to the second major surface of the wall panel by the chemical adhesive layer. The second face of the insulating material can have a capillary break recess disposed between the first face and the support recess, the capillary break recess disposed parallel to the building substrate.

In another embodiment, an adjustable building panel support device is described. The adjustable building panel support device includes a support bracket configured to fixedly engage a building substrate, and a building panel support device comprising a plate section having a proximal portion and a distal end, a first support flange orthogonally intersecting the plate section at the distal end, and a second support flange orthogonally intersecting the plate section at a location spaced between the proximal portion and the distal end. The length of the second support flange in a direction orthogonal to the plate section is greater than the length of the first support flange in the direction orthogonal to the plate section. The building panel support element is configured to be fixed to the support bracket at a user determinable distance from the building substrate.

The first support flange and the second support flange can be spaced apart along the plate section by a distance greater than the length of the first support flange in a direction orthogonal to the plate section. The support bracket can comprise a first planar portion configured to engage the building substrate and a second planar portion extending at an angle from the first planar portion, the second planar portion configured to support the building panel support element. The support bracket can further comprise a leveling screw configured to adjust an angle between the building substrate and the second planar portion of the support bracket. The building panel support element can comprise a combination of a polymer and a metal. The building panel support element can be configured to be fixed to the support bracket by at least one connector comprising at least one of a mechanical connector and an adhesive.

In another embodiment, an insulated building panel is described. The insulated building panel comprises a wall panel comprising a first major surface, a second major surface parallel to the first major surface, and a pair of opposing edges, each opposing edge having a recess parallel to the first major surface and configured to receive a first support flange, and an insulating material comprising a first face and a second face disposed at an angle relative to the first face, the first face being fixed to the second major surface of the wall panel, the second face having a support recess parallel to the first face and configured to receive a second support flange.

The support recess of the insulating material can be deeper than the recess of the wall panel. The insulated building panel can further comprise a chemical adhesive layer disposed between the first face of the insulating material and the second major surface of the wall panel, wherein the first face of the insulating material is fixed to the second major surface of the wall panel by the chemical adhesive layer. The wall panel can comprise a fiber cement substrate. The insulating material can comprise at least one of polyurethane, polystyrene, polyisocyanurate, thermoset phenolic, calsil board, mineral fiber board, open cell foam, and closed cell foam. The insulated building panel can further comprise a reflective foil layer disposed between the first face of the insulating panel and the second major surface of the wall panel. The second face of the insulating material can have a capillary break recess disposed between the first face and the support recess.

In one embodiment the building panel support element comprises a first section comprising a pair of opposing main faces and at least one edge member positioned intermediate the at least two opposing main faces, and a first panel retaining formation for supporting and retaining at least one building panel. In one embodiment the first section comprises a plate section. In a further embodiment the first panel retaining formation is disposed along the at least one edge member of the first section. Conveniently, the first section or plate section is provided with means to enable the first section or plate section to connect to the support bracket. In one embodiment, the first section and support bracket can be securably held together using the at least one connector. In a further embodiment either face of the pair of opposing main faces of the first section of the building support element is contactable with the support bracket and positionally adjustable to define a user determinable spacing and/or orientation between the first panel retaining formation and support bracket.

In a further embodiment the support bracket comprises a first portion, comprising a substrate engaging surface and a second portion, for supporting at least one building panel support element. Conveniently, the second portion is provided with means to enable the first section or plate section to connect to the support bracket. In one embodiment, the first section and support bracket can be securably held together using the at least one connector. In a further embodiment the substrate engaging surface is secured to a building substrate at user defined locations on a substrate surface. The first or plate section of the building support element and the second portion of the support bracket being fixable at the user determinable position by the at least one connector and thereby ameliorate the effects of substrate variability.

Accordingly in a further embodiment, there is provided an adjustable building panel support device comprising:

a building panel support element comprising a plate section comprising a pair of opposing main faces and at least one edge member positioned intermediate the at least two opposing main faces, and a first panel retaining formation disposed along at least a portion of the at least one edge member of the plate section, for supporting and retaining at least one building panel;

a support bracket comprising a first portion, comprising a substrate engaging surface, and a second portion, for supporting at least one building panel support element; and at least one connector for connecting the building panel support element to the support bracket at a user determinable position, wherein either face of the pair of opposing main faces of the plate section is contactable with the second portion of the support bracket and is positionally adjustable to define a user determinable spacing and/or orientation between the first panel retaining formation and the substrate engaging surface, the plate section of the building support element and the second portion of the support bracket being fixable at the user determinable position by at least one connector, for ameliorating the effects of substrate variability.

In one embodiment, the first panel retaining formation is at least one flange.

In a further embodiment, each flange extends at an angle from an edge of the plate section. Conveniently, in one embodiment, at least one flange extends at a right angle from an edge of the plate section.

In a further embodiment, the adjustable building panel support device further comprises a second panel retaining formation. In one embodiment, the second panel retaining formation is disposed on the building panel support element. In a further embodiment, the second panel formation is disposed on, and extends from, at least one of the pair of opposing faces of the plate section. In an alternative embodiment, the second panel retaining formation is disposed on the support bracket.

In one embodiment, the second panel retaining formation comprises at least one flange.

In one embodiment, the second panel retaining formation is substantially parallel to the first panel retaining formation. In a further embodiment, the second panel retaining formation is spaced apart from the first panel retaining formation, for defining at least one panel retaining channel.

In one embodiment, the support bracket comprises an angle bracket. In one embodiment, the angle bracket is substantially a right angle bracket.

In one embodiment, the substrate engaging surface further comprises at least one adjustment means, for adjusting the angle of the second portion of the support bracket relative to a substrate.

In one embodiment, the building panel support element further comprises a spacer plate, connectable to the plate section, for extending the user determinable distance achievable between the first panel retaining formation and the substrate engaging surface.

In one embodiment the at least one connector is selected from the group comprising mechanical connectors, chemical connectors or combinations thereof.

In one embodiment the building panel support element is a continuous section. In an alternative embodiment, the building panel support element is a discrete section.

In one embodiment the support bracket is a continuous section. In an alternative embodiment, the support bracket is a discrete section.

In one embodiment, at least the panel support element is formed from a polymer.

In one embodiment, the polymer comprises polyvinylchloride.

In one embodiment, at least the panel support element is formed from a metal.

In one embodiment, the building panel comprises fibre cement.

Accordingly, in a further embodiment, there is provided a system comprising at least one adjustable building panel support device, each adjustable building panel support device comprising a building panel support element comprising a first section having a pair of opposing main faces and at least one edge member positioned intermediate the at least two opposing main faces, and a first panel retaining formation disposed along at least a portion of the at least one edge member of the plate section, for supporting and retaining at least one building panel;

a support bracket comprising a first portion, comprising a substrate engaging surface, and a second portion, for supporting at least one building panel support element;

at least one connector for connecting the building panel support element to the support bracket at a user determinable position; and at least one wall panel, each panel comprising a first face for supporting a decorative finish, a first pair of opposing edges, at least a portion of each of the first pair of opposing edge being configured to engage a primary panel retaining formation of a first panel support element, and a second pair of opposing edges, at least a portion of each of the second pair of opposing edges being configured to engage a corresponding edge of an adjacent panel.

In a further embodiment, each edge of the first pair of opposing edges are configured to engage with the primary panel retaining formation of the first panel support and each edge of the second pair of opposing edges are configured to engage with the corresponding edge of an adjacent panel.

Conveniently, in use the substrate engaging surface of the support bracket is fixed into a user determinable position on a substrate, a face of a pair of opposing main faces of the first section of a building panel support element is brought into contact with the second portion of the support bracket, the distance of the primary panel retaining formation is adjusted relative to the substrate to define a predetermined spacing, the first section of the building support element and the second portion of the support bracket are fixed together by the at least one connector, at least one wall panel is positioned so that one edge of the panel engages the first panel retaining formation. A second building support element is then positioned so that it engages with the second side edge of the pair of opposing side edges of the at least one wall panel, and the plate section of the second building support element is fixed to the second portion of the support bracket of the second building support element. In this way, the distance between the substrate and the wall panel is adjusted for each wall panel during installation to ameliorate the effects of irregularities in the substrate when constructing a wall section.

According to one embodiment there is provided a method of constructing a wall section comprising:

(a) providing a plurality of adjustable building panel support devices, each device comprising a panel support element, a support bracket, and at least one connector;

(b) forming a user determined array of building panel support brackets fixed to a substrate by sequentially bringing the substrate engaging surface of the first portion of each support bracket into contact with the building substrate and fixing the first portion of each support bracket to the substrate at a user determined position;

(c) bringing a face of the plate section of a first building panel support element into contact with the second portion of at least one support bracket;

(d) positionally adjusting the building panel support element relative to the support bracket to define a user determinable spacing and/or orientation between the first panel retaining formation and the substrate engaging surface;

(e) fixing the plate section of the building panel support element and a corresponding second portion of a support bracket together using at least one connector;

(f) positioning at least one wall panel so that one edge a pair of opposing side edges of each building panel engages and is retained by at least a first panel retaining formation;

(g) positioning at least a first panel retaining formation of a second building support element so that it engages the second side edge of the pair of opposing side edges of at least one building panel, and (h) fixing the plate section to the second portion of at least one respective support bracket, and (i) repeating steps (f) (g) and (h) until a desired substrate coverage has been achieved.

The systems, methods and devices described herein have innovative aspects, no single one of which is indispensable or solely responsible for their desirable attributes. Without limiting the scope of the claims, the summary above describes some of the advantageous features.

BRIEF DESCRIPTION OF THE DRAWINGS

Certain embodiments of the present disclosure will now be described, by way of example only, with reference to the accompanying drawings. From figure to figure, the same or similar reference numerals are used to designate similar components of an illustrated embodiment.

DETAILED DESCRIPTION

Although the present disclosure is described with reference to specific examples, it will be appreciated by those skilled in the art that the present disclosure may be embodied in many other forms.

Figure 1:
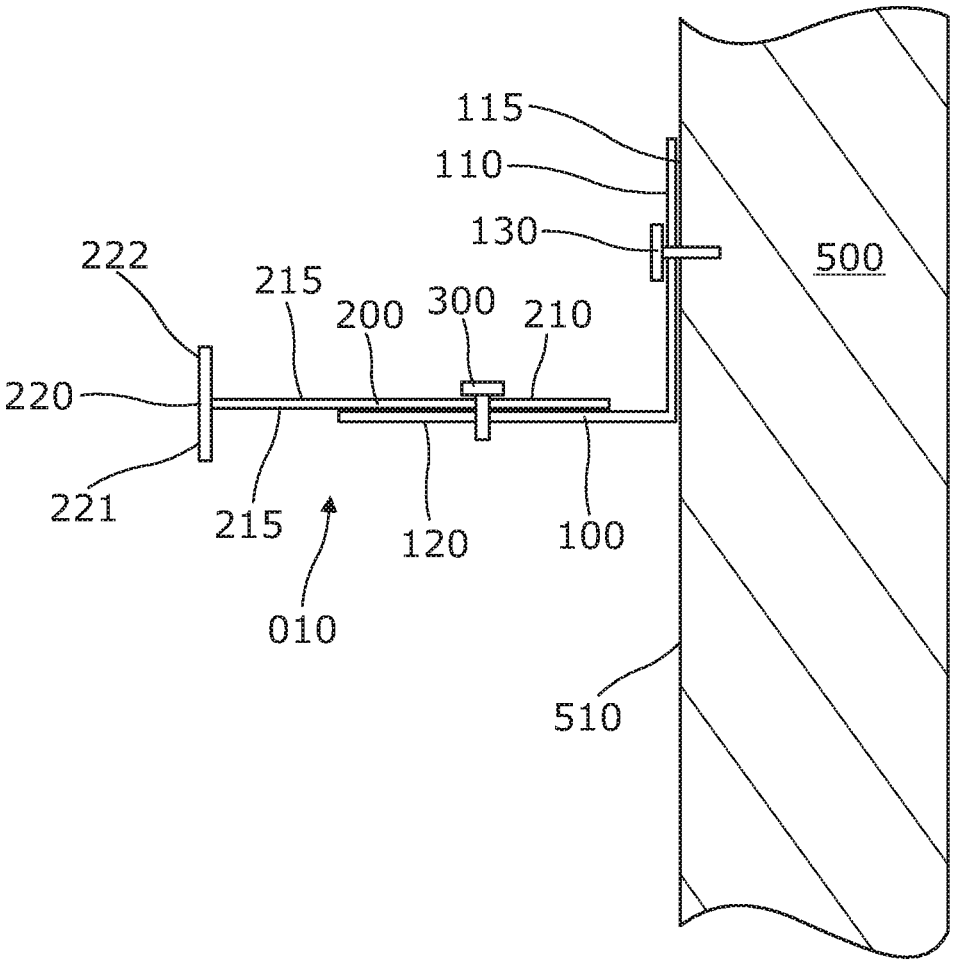
FIG. 1 is a cross sectional side view of an embodiment of an adjustable building panel support device.

Referring to the drawings and specifically to FIG. 1, there is shown one embodiment of an adjustable building panel support device 010, comprising a building panel support element 200 having a plate section 210, wherein the plate section 210 comprises a pair of opposing main faces 215, and a first panel retaining formation 220 disposed along at least one edge of the plate section. The first panel retaining formation 220 is suitable for supporting and retaining at least one building panel. The adjustable building panel support device 010 further comprises a support bracket 100 comprising a first portion 110 comprising a substrate engaging surface 115, and a second portion 120, for supporting at least one building panel support element 200; and at least one connector 300 for connecting the or each building panel support element 200 to the support bracket 100 at a user determinable position.

In use, the substrate engaging surface 115 of the first portion 110 of the support bracket 100 is secured to a surface 510 of a substrate 500 using connector 130.

Either face of the pair of opposing main faces 215 of plate section 210 of building panel support element 200 can be contactable with the second portion 120 of support bracket 100. Conveniently, the building panel support element 200 is positionally adjustable relative to the second portion 120 of support bracket 100 to define a user determinable spacing and/or orientation between the first panel retaining formation 220 and the substrate engaging surface 115, plate section 210 of building panel support element 200 and second portion 120 of support bracket 100 being fixable at the user determinable position by at least one connector 300, for ameliorating the effects of substrate variability.

The first panel retaining formation 220 comprises at least one flange. In FIG. 1, a pair of flanges 221, 222 each extend at a right angle from an edge of plate section 210 to provide a co-planar building panel support structure. Although the flanges 221, 222 of the panel retaining formation 220 are depicted as extending at a right angle from the edge of the plate section 210, in alternate configurations the panel retaining formation 220, whether in the form of one or more flanges, or otherwise, may extend from the edge of the plate section 210 at other angles, and the angles may be fixed or adjustable. In alternate configurations, each flange 221, 222 or other configuration of the first panel retaining formation, may extend at a different angle from the plate section 210. In one embodiment, the flanges are pivotable relative to the plate section and can be locked into place at the desired angle. Thus, the distance between the building panel support element and the support bracket can advantageously be varied, thereby accommodating surface variations that may be present on a substrate surface.

Figure 2B:
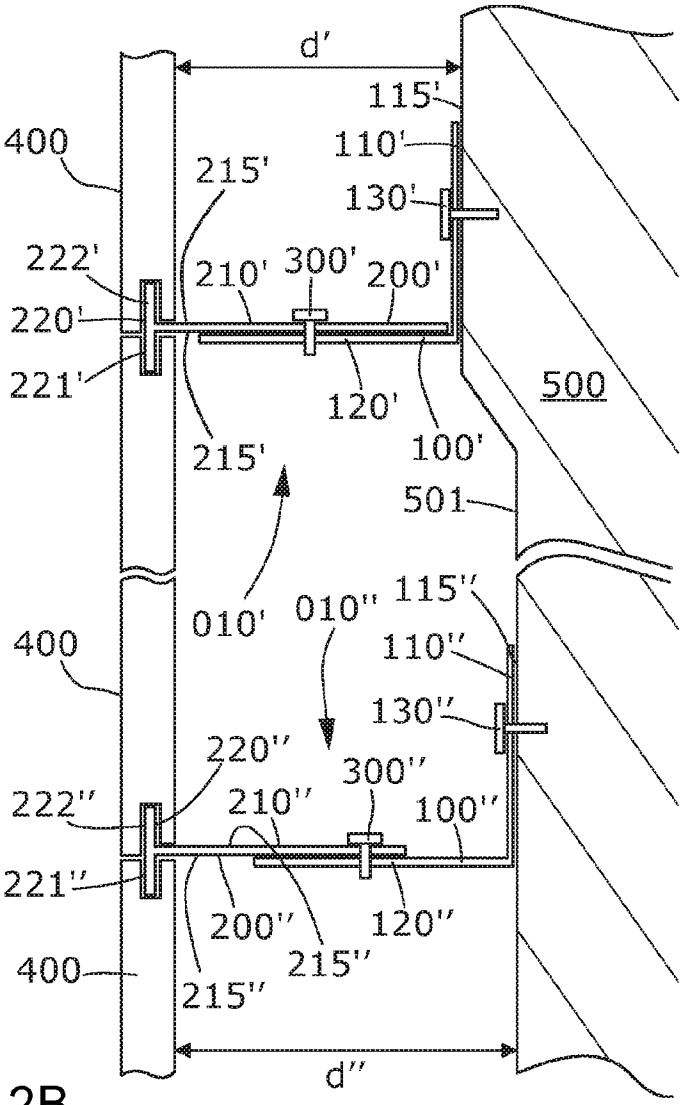
FIG. 2B is a cross sectional, section side view of an embodiment of an adjustable building panel support device, in use on variable surface substrate with varying overlap of the plate section and the second portion of the support bracket.
Figure 2A:
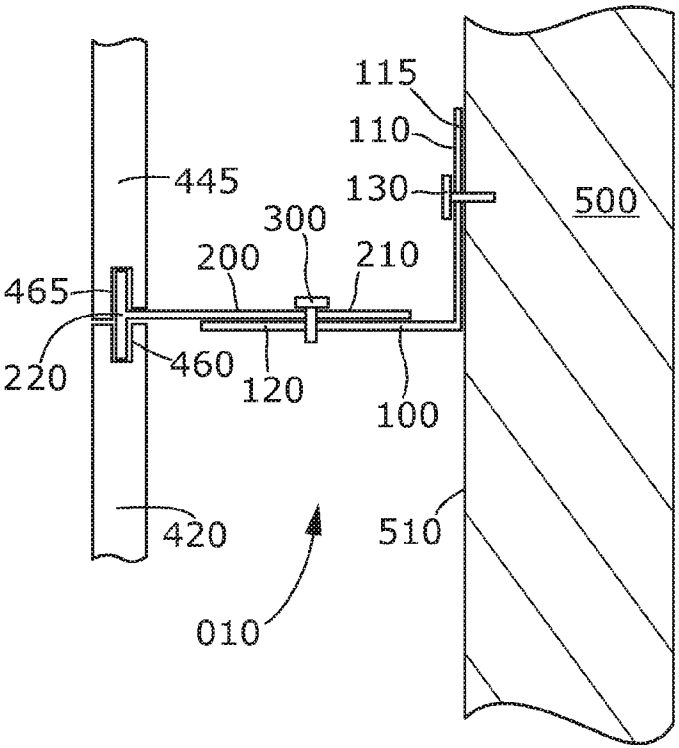
FIG. 2A is a cross sectional, section side view of an embodiment of an adjustable building panel support device, in use on a straight substrate.

Referring now to FIGS. 2A and 2B, there is shown an adjustable building panel support device use as part of a building panel assembly. In FIG. 2A, substrate engaging surface 115 of support bracket 100 is fixed to substrate 500 by connector 130. A first building panel 420 and a second building panel 445, in this case wall panels, are shown with recesses 460 and 465 in the edge portions of the wall panels 420, 445. The edge portions are engaged with and retained by the flanges of panel retaining formation 220. The outer section of the edge portion of building panels 420, 445 partially obscures panel retaining formation 220.

In FIG. 2B, an example of an adjustable building panel support device 010', 010" is shown in use in construction of a wall section, where the substrate is not a flat surface but contains irregular or profiled sections. In this embodiment, the overlap between the plate section of a panel support element and a panel support bracket may be adjusted to accommodate variability in the surface of substrate 500, as substrate 500 includes a recessed portion 501. Substrate engaging surface 115" of a first support bracket 100" is fixed to recessed substrate portion 501 by connector 130". Substrate engaging surface 115' of a second support bracket 100' is connected to substrate 500 by connector 130'. One face 215' of plate section 210' of building panel support element 200' is in contact with the second portion 120' of support bracket 100'. Building support element 200' is positionally adjusted to provide a user determined spacing d' between panel retaining formation 220' and substrate 500' and then plate section 210' is connected to second portion 120' of first support bracket 100' by at least one connector 300'. In this example, each connector 300' is a screw. Other forms of mechanical connector such as nails, scrails, staples, hook and loop fastener, and the like may also be suitable. Alternatively, chemical connectors such as adhesives may be used alone, or in combination with mechanical connectors.

Building panel support element 200" is in contact with second portion 120" of second support bracket 100". The overlap of plate section 210" with second portion 120" of second support bracket 100" is positionally adjusted to provide a user determined spacing d" between panel retaining formation 220" and recessed substrate 501. As above, once the desired spacing d" has been achieved, plate section 210" and support bracket 100" can be fixed together by connector 300". The difference in overlap of each plate section 210', 210" and its respective support bracket 110', 110", allowing panel retaining formations 220', 220" to form a co-planar surface.

The co-planar positioning of each panel retaining formation enables construction of a substantially planar surface of the building section such as a wall section, irrespective of variability in the substrate surface, and where the resultant substantially planar surface of adjacent building panels in the building section further enables ease of installation of a decorative surface finish, such as a decorative paint finish or textured render finish.

A user such as a builder, architect or designer can also design a non-planar surface of a building section by customizing the defined spacing between a panel retaining formation of a building panel support element and a substrate at each of a range of locations in an array of fixing points on the substrate, to form a customized non-planar surfaced building section, or an optimum spacing or cavity distance between each panel retaining formation and a corresponding location on the substrate.

Figure 3B:
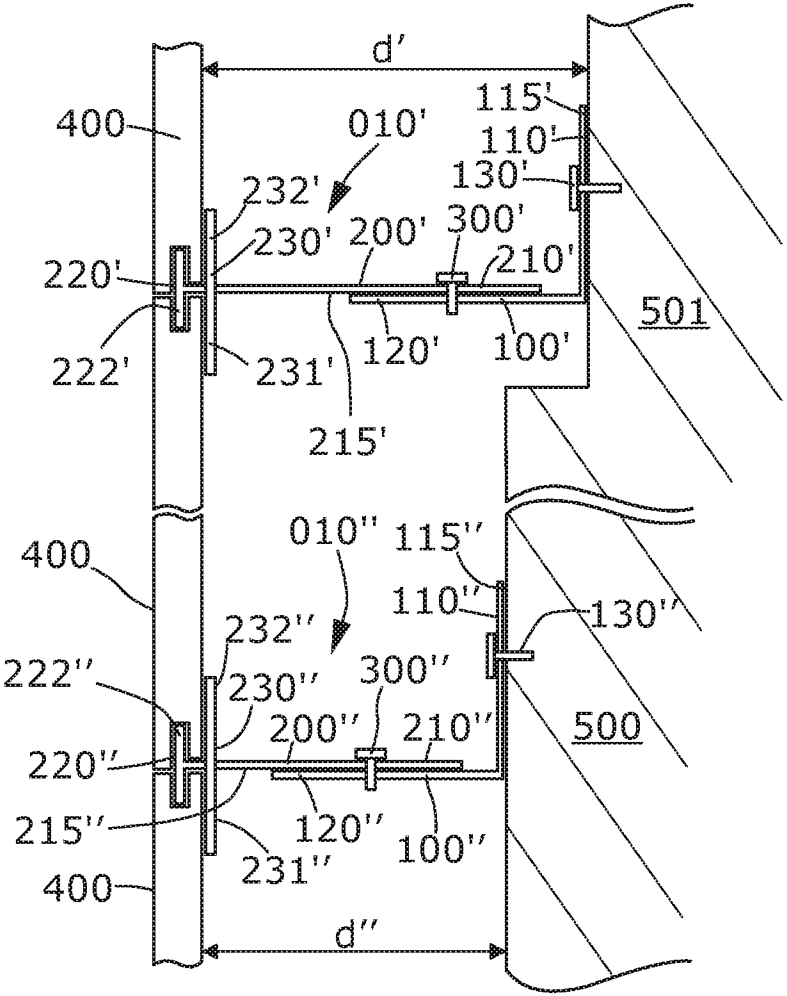
FIG. 3B is a cross sectional, section side view of an embodiment of an adjustable building panel support device, in use on a variable surface substrate.
Figure 3A:
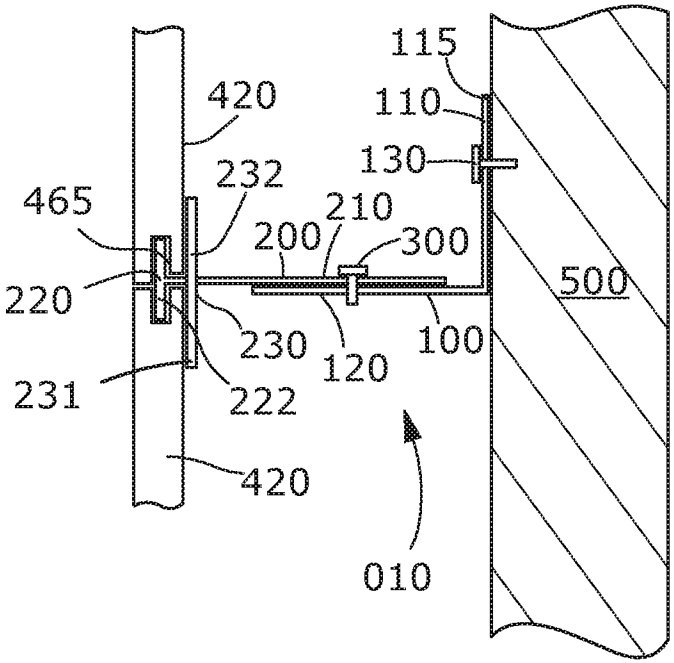
FIG. 3A is a cross sectional, section side view of an embodiment of an adjustable building panel support device, in use on a straight substrate.

In one embodiment, as seen in FIG. 3A, adjustable building panel support device 010 further comprises a second panel retaining formation 230. Second panel retaining formation 230 may be located on plate section 210 of panel support element 200. Second panel retaining formation 230 may be in the form of at least one flange 231, 232 in this embodiment, each flange extending substantially orthogonally from plate section 210 and substantially parallel to, and spaced apart from, first panel retaining formation 220. In this embodiment, flange 222 of first panel retaining formation 220 and flange 232 of second panel retaining formation 230 are spaced apart only sufficiently to accept and retain second lip portion 465 of panel 400 when installed. Each second panel retaining formation 230 may extend at angles other than 90 degrees from plate section 210, the embodiment shown should be regarded as an illustrative example of a range.

In FIG. 3B, an example of an adjustable building panel support device 010', 010" is shown in use in construction of a wall section where the substrate is not a flat surface but contains irregular or profiled sections. In this embodiment, the overlap between the plate section of a panel support element and a panel support bracket may be adjusted to accommodate variability in the surface of substrate 500. In this example, substrate 500 includes a recessed portion 501. Substrate engaging surface 115' of a first support bracket 100' is fixed to recessed substrate portion 501 by connector 130'. Substrate engaging surface 115" of a second support bracket 100" is connected to substrate 500 by connector 130". One major face 215' of plate section 210' of building panel support element 200' is in contact with the second portion 120' of support bracket 100'. Building support element 200' is positionally adjusted to provide a user determined spacing between d' panel retaining formation 220' and substrate 500' and then plate section 210' is connected to second portion 120' of first support bracket 100' by at least one connector 300'. In this example, each connector 300' is a screw.

In this embodiment, substrate 500 includes a portion 501 whose surface is not generally co-planar with the rest of the substrate surface. In this embodiment, the non co-planar portion is a recessed portion 501. To accommodate the extra distance required to be spanned because of the recess, and in order to install building panels to form a co-planar surface array in a constructed building section, panel support elements 200', 200" may be provided that have different plate section 210', 210" widths.

In FIG. 3B, plate section 210' is wider than plate section 210", thereby allowing the same degree of overlap of faces 215', 215" with respective second portion 120', 120" of a respective support bracket 100', 100". Spacing d', d" between respective first panel retaining formation 220', 220" and substrate 501,500 is positionally adjustable by moving plate section 210', 210" relative to second portion 120', 120" of a respective support bracket 100', 100", both to alter the distance d', d" between first panel retaining formation 220', 220" and substrate 501, 500 and also to change the angle between the axis perpendicular to substrate engaging surface 115', 115" of first portion 110', 110" and the axis perpendicular to first panel retaining formation 220', 220", if necessary, to define a user determinable distance and overcome any other variability in the substrate surface. Plate section 210 of a building panel support element 200 can be further extended by attaching an extension plate section using a mechanical or chemical fixing method, or a combination thereof.

Similarly to the configuration shown in FIG. 3A, adjustable building panel support device 010', 010" further comprises a second panel retaining formation 230', 230". Second panel retaining formation 230', 230" may be disposed on, and extend from, at least one of the opposing pair of major faces of a respective plate section 210', 210" of panel support element 200', 200". Second panel retaining formation 230', 230" may be in the form of at least one flange 231',232', 231", 232" in this embodiment, each flange extending substantially orthogonally from plate section 210', 210" and substantially parallel to, and spaced apart from, first panel retaining formation 220', 220" and each defines a panel retaining channel. In this embodiment, flange 222', 222" of first panel retaining formation 220', 220" and flange 232', 232" of a respective second panel retaining formation 230', 230" are spaced apart only sufficiently to accept and retain second lip portion of a respective panel 400', 400" when installed. Each second panel retaining formation 230', 230" may extend at angles other than 90 degrees from plate section 210', 210".

Figure 4:
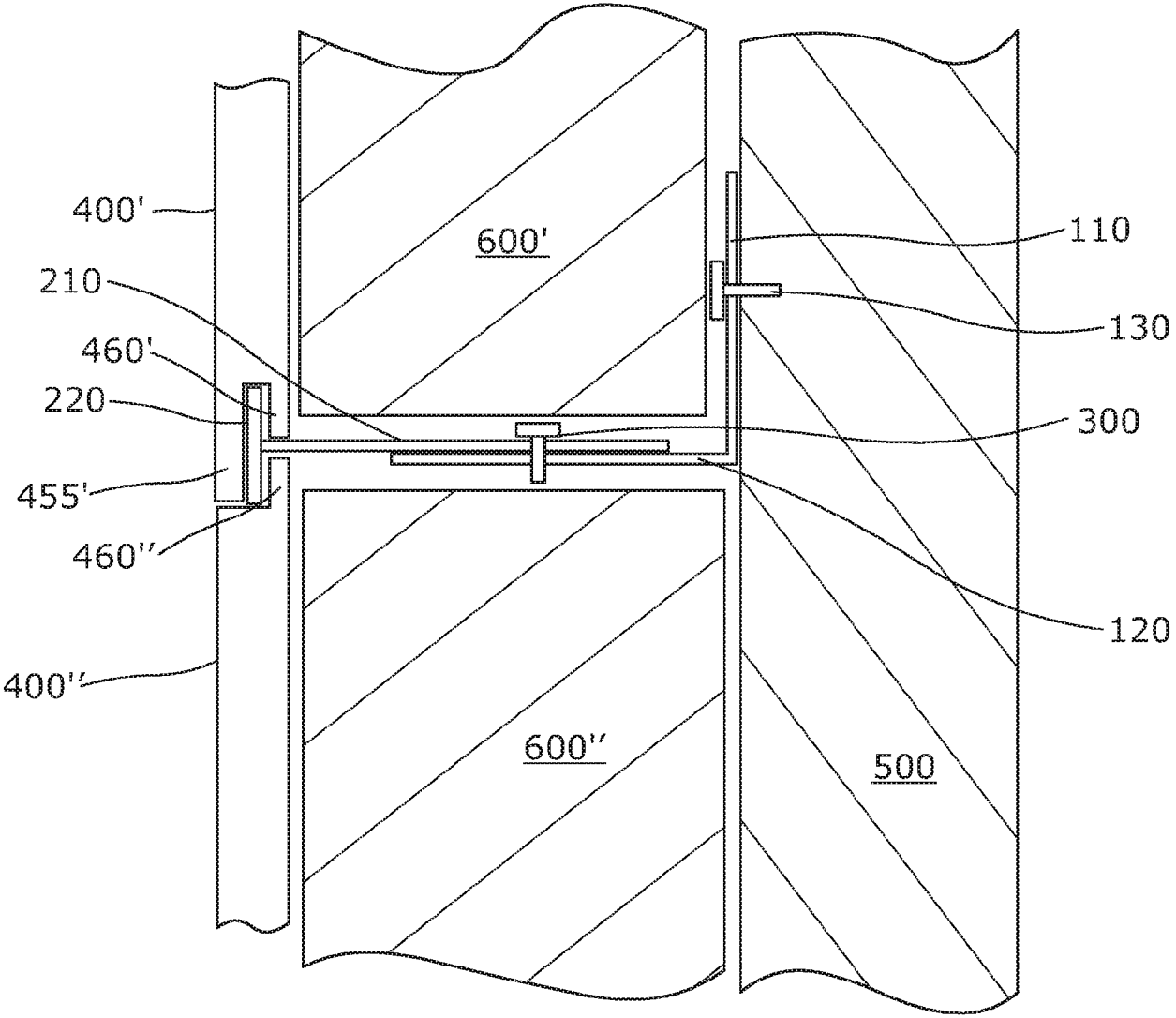
FIG. 4 is a cross sectional side view of a wall section constructed according to certain embodiments of the present disclosure, using at least one adjustable building panel support device and including optional insulation, the building panels showing a pair of side edges optionally configured to obscure the panel retaining formation of the adjustable building panel support device.

In one embodiment, as shown in FIG. 4, the space between the rear face of each respective panel 400', 400" and substrate 500 can be filled with an insulating material 600', 600" such as mineral wool, for providing thermal and/or acoustic insulation to a constructed building section, such as a wall section. In this embodiment, an alternate configuration of opposing major side edges of adjacent building panels 400', 400" is shown, where side edge of panel 400' has been configured such that first lip 455' completely obscures first panel retaining formation 220. Correspondingly, first lip of adjacent panel 400" has been substantially removed. For both panels 400', 400", second lip 460', 460" on the side edge are configured to be retained by first panel retaining formation 220.

Figure 5:
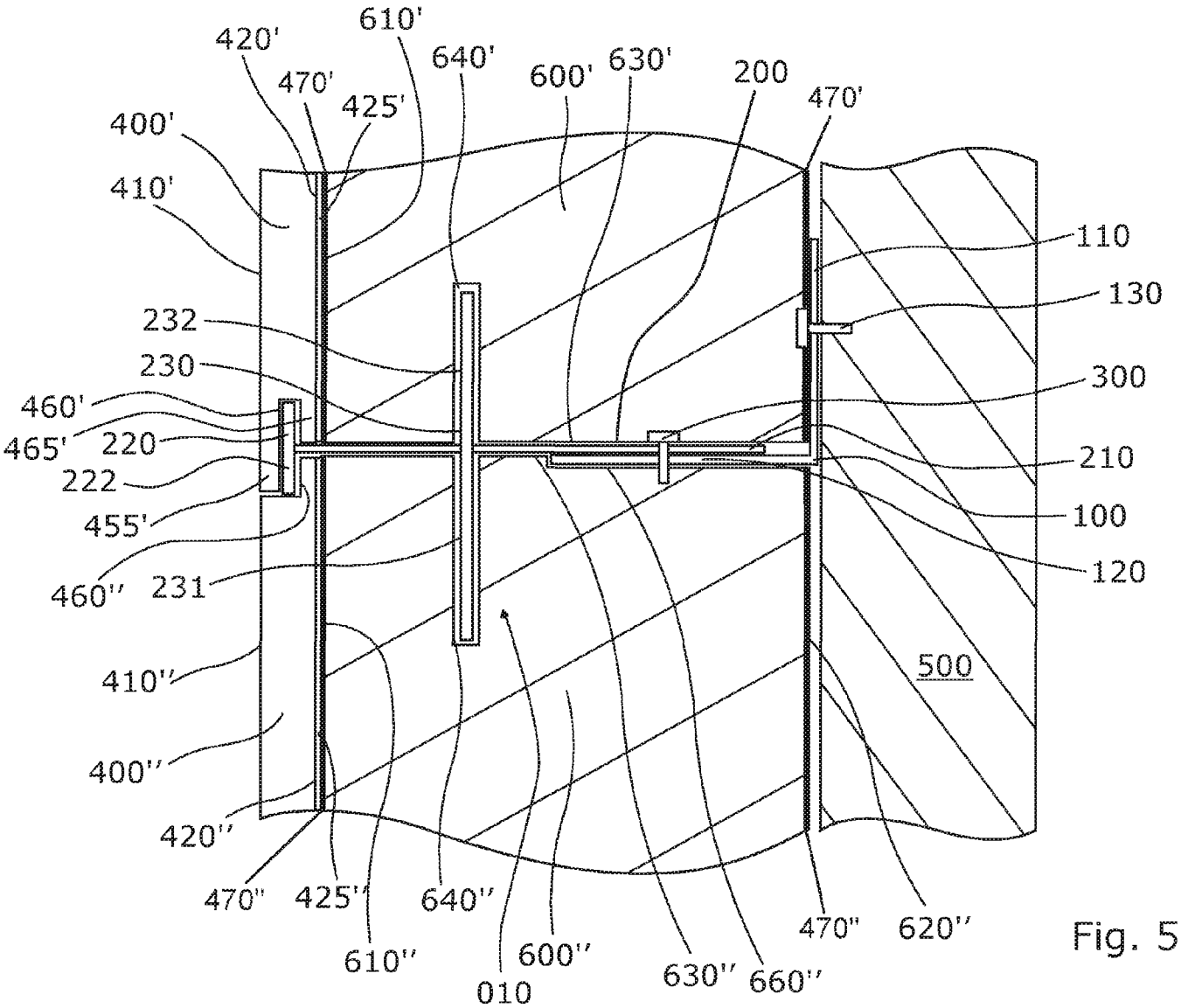
FIG. 5 is a cross sectional side view of an insulated wall section constructed according to certain embodiments of the present disclosure, using at least one adjustable building panel support device comprising a first panel retaining formation supporting and retaining each wall panel and a second panel retaining formation retaining and supporting an integral insulation layer.

With reference to FIG. 5, an adjustable building panel support device 010 of another embodiment is shown. The device 010 is configured to support and secure wall panels 400', 400" with an insulating material 600', 600" either attached thereto or integrally formed on the rear face of the wall panel 400', 400".

As shown in FIG. 5, the adjustable building panel support device 010 generally includes a support bracket 100 and a building panel support element 200 having a plate section 210 and a first and a second retaining formation 220, 230 arranged in a spaced apart relationship on the plate section 210. The plate section 210 extends in a longitudinal direction and is configured to support one or more building panels 400', 400". Each of the retaining formations 220, 230 extends outwardly from the plate section 210 at an angle of 90 degrees or less. The retaining formations 220, 230 can be in the form of flanges or other planar structure. In one implementation, the first retaining formation 220 is disposed along an outer edge of the plate section 210 and the second retaining formation 232 is disposed along the length of an interior portion of the plate section 210. The second retaining formation 232 can be set back from the first retaining formation 220 by a predetermined distance such as no greater than 100 centimeters (cm) or between 50 to 100 centimeters (cm). The width of the second retaining formation 232 can be greater than the width of the first retaining formation 232 such that the ratio of the two widths is at least 3 to 1.

FIG. 5 further shows the building panel support element 200 being secured to the support bracket 100 by connector 300. First retaining formation 220 and second retaining formation 230 are configured to engage and/or interlock with corresponding grooves or recesses in building panels 400', 400" and insulating material 600', 600" to retain building panels 400', 400" and insulating material 600', 600" in a substantially fixed position and orientation relative to the building panel support element 200. The plate section 210 of the building panel support element 200 is fixed to or formed integrally with the first retaining formation 220 and the second retaining formation 230. In some implementations, the first retaining formation 220 is located at the distal extent of the plate section 210 and includes a first support flange 222 extending at an angle from the plate section 210. For example, first support flange 220 may be orthogonal to plate section 210 or may extend at a different fixed or user determinable angle from the distal end of the plate section 210. Second retaining formation 230 is disposed at an intermediate location along the plate section 210, and is spaced proximally from first retaining formation 220. Second retaining formation 230 includes second support flanges 231, 232 extending at an angle from the plate section 210. In some embodiments, second support flanges 231 and 232 may be integrally formed as a single flange intersecting the plate section 210. Similar to first support flange 222, second support flanges 231, 232 may be orthogonal to plate section 210 or may extend at a different fixed or user determinable angle. In some embodiments, the angles of the first support flange 222 and second support flanges 231, 232 can be the same such that first support flange 222 and second support flanges 231, 232 are parallel, for example, to facilitate the installation of cladding to the adjustable building panel support device 010. The spacing between first retaining formation 220 and second retaining formation 230 may be larger than the thickness of building panels 400', 400" such that the first retaining formation 220 is configured to support building panels 400', 400", while second retaining formation 230 is configured to support insulating materials 600', 600".

As further shown in FIG. 5, a portion of the plate section 210 proximal to second retaining formation 230 is configured to abut and lie substantially parallel to the support element engaging section 120 of the support bracket 100. The support element engaging section 120 of the support bracket and the plate section 210 of the building panel support element 200 are both configured to receive connector 300 to secure the building panel support element 200 to the support bracket 100. In various embodiments, either or both of the building panel support element 200 and the support bracket 100 can receive connector 300 at a plurality of different longitudinal positions in order to allow a user to determine the spacing between the building surface 500 and retaining formations 220, 230. In some aspects, a plurality of connectors 300 can be provided along the longitudinal distance shared by the support element engaging section 120 and the plate section 210 to strengthen the connection between the support bracket 100 and the building panel support element 200.

Panel support element 200 may be formed from a polymer, such as a polyvinylchloride (PVC), but other polymers may also be suitable. Alternatively, such as where local building codes, fire regulations and the like may prevent the use of a polymeric material, panel support element 200 may also be formed from metal, such as steel or aluminum, and the like, or a combination of a polymer and a metal. Panel support element 200 may be an elongate extruded section, or may comprise discrete individual elements.

Similarly, support bracket 100 may be a continuous length extrusion, or may comprise discrete individual brackets. Support bracket 100 would generally be formed from metal, but may be formed from other materials so long as it can meet any calculated load requirements required under local building codes or regulations. Support bracket 100 in the embodiments shown here is in the form of an angle bracket, particularly a right angle bracket, but may be provided in other configurations.

Wall panels 400', 400" include a first major surface 410', 410" and a second major surface 420', 420". Wall panels 400', 400" can be formed from any durable building material. For example, panels 400', 400" can include a material with low thermal conductivity properties, such as fibre cement, to improve the overall thermal performance of the building section. Insulating material 600', 600" can include a substantially rigid material, and includes a first surface 610', 610", a second surface 620', 620", and a third surface 630', 630". Suitable insulating materials 600', 600" may include polymeric materials, such as polyurethane (PU), polystyrene, polyisocyanurate (PIR), thermoset phenolic, polymeric foams, and the like. Substantially rigid inorganic insulating materials may also be used, such as calsil board, mineral fibre board, and the like.

First major surface 410', 410" of wall panels 400', 400" can be an exterior surface configured to receive paint, texture, or any other decorative finish. Second major surface 420', 420" of wall panels 400', 400" is configured to be applied, attached, integrally formed, or coupled, directly or indirectly, to the first surface 610', 610" of insulating material 600', 600". For example, the second major surface 420', 420" of wall panels 400', 400" can be chemically fixed to the first surface 610', 610" of insulating material 600', 600" by an adhesive 425', 425", which may form an adhesive layer between wall panels 400', 400" and insulating material 600', 600". One or more reflective foil layers 470', 470" may also be provided. In various embodiments, reflective foil layers 470', 470" may be located along the first surface 610', 610" and/or the second surface 620', 620" so as to further improve the thermal insulation performance of the wall panels 400', 400" and insulating material 600', 600". Reflective foil layers 470', 470" may be formed integrally as a part of wall panels 400', 400", as a part of sections of insulating material 600', 600", or may be provided and adhered as an additional layer between wall panels 400', 400" and insulating material 600', 600". Insulated panel sections including a wall panel 400', 400", insulating material 600', 600", reflective foil layer(s) 470', 470", and/or adhesive 425', 425", may be manufactured prior to installation such that an installer can attach a single insulation-backed panel section to one or more installed building panel support device 010, rather than being required to separately install a panel 400', 400" and an insulating material 600', 600".

Wall panels 400', 400" with integral insulating material 600', 600" are configured to be supported and retained by the adjustable building panel support device 010. Accordingly, insulating materials 600', 600" include recesses 640', 640" sized, shaped, and located so as to receive and at least partially surround second support flanges 231, 232. Similarly, wall panels 400', 400" include recesses 460', 460" sized, shaped, and located so as to receive and at least partially surround first support flange 222. The angled disposition of flanges 222, 231, and 232 relative to the longitudinal orientation of the building panel support element 200 prevent building panels 400', 400" and insulating material 600', 600" from moving longitudinally away from their locations as installed. Preferably, the longitudinal spacing between recesses 460', 460" and recesses 640', 640" should be approximately equal to the longitudinal spacing between first retaining formation 220 and second retaining formation 230. Thus, in some manufacturing implementations, recesses 640', 640" and/or recesses 460', 460" may be formed after the attachment of wall panels 400', 400" to insulating materials 600', 600". Accordingly, installation of each panel may be advantageously facilitated, guided, and/or stabilized by the presence of two retaining formations 220, 230 configured to accommodate and support preformed recesses 460', 460" and 640', 640" sized, shaped, and located to receive retaining formations 220, 230. A third recess 660" may further be provided along the third edge 630" of insulating material 600" to accommodate the support element engaging section 120 of support bracket 100 to permit close stacking of adjacent panels 400' and 400" and/or insulation materials 600' and 600". Close stacking may optimize thermal insulation by preventing thermal loss through gaps.

In some embodiments, the edges of panels 400', 400" at the interface between the panels 400', 400" and the first support flange 222 may be advantageously shaped to improve the performance of panels 400', 400". In some embodiments, recess 460' of panel 400' is surrounded by a first lip 455' and a second lip 465', while recess 460" of panel 400" comprises a single L-shaped cutout such that second major surface 420" extends to abut the plate section 210 of the building panel support element 200, while second major surface 410" extends only as far as the end of the first support flange 222 and first lip 455. Thus, when installed, first lip 455 extends to completely obscure first retaining formation 220. In some embodiments, the edges of panels 400', 400" may further include decorative profiles such as a shiplap profile or other external shape. In addition, the complementary interface profiles of panels 400' and 400" prevent the existence of a direct longitudinal path between panels 400' and 400" at any point along the length of panels 400' and 400". Any water or other liquid that seeps or otherwise enters the wall section through the interstice between first lip 455' and panel 400" can only reach the building surface 500 or interior space occupied by insulating materials 600', 600" by traveling upward to the interstice between second lip 465' and panel 400". Thus, the complementary interface profiles of panels 400' and 400" may provide several advantages, including obscuring the joint line between adjacent panels, obscuring external visibility of retaining formation 220, and prevention or reduction of migration of water or other substances into or through the joints.

Figure 6:
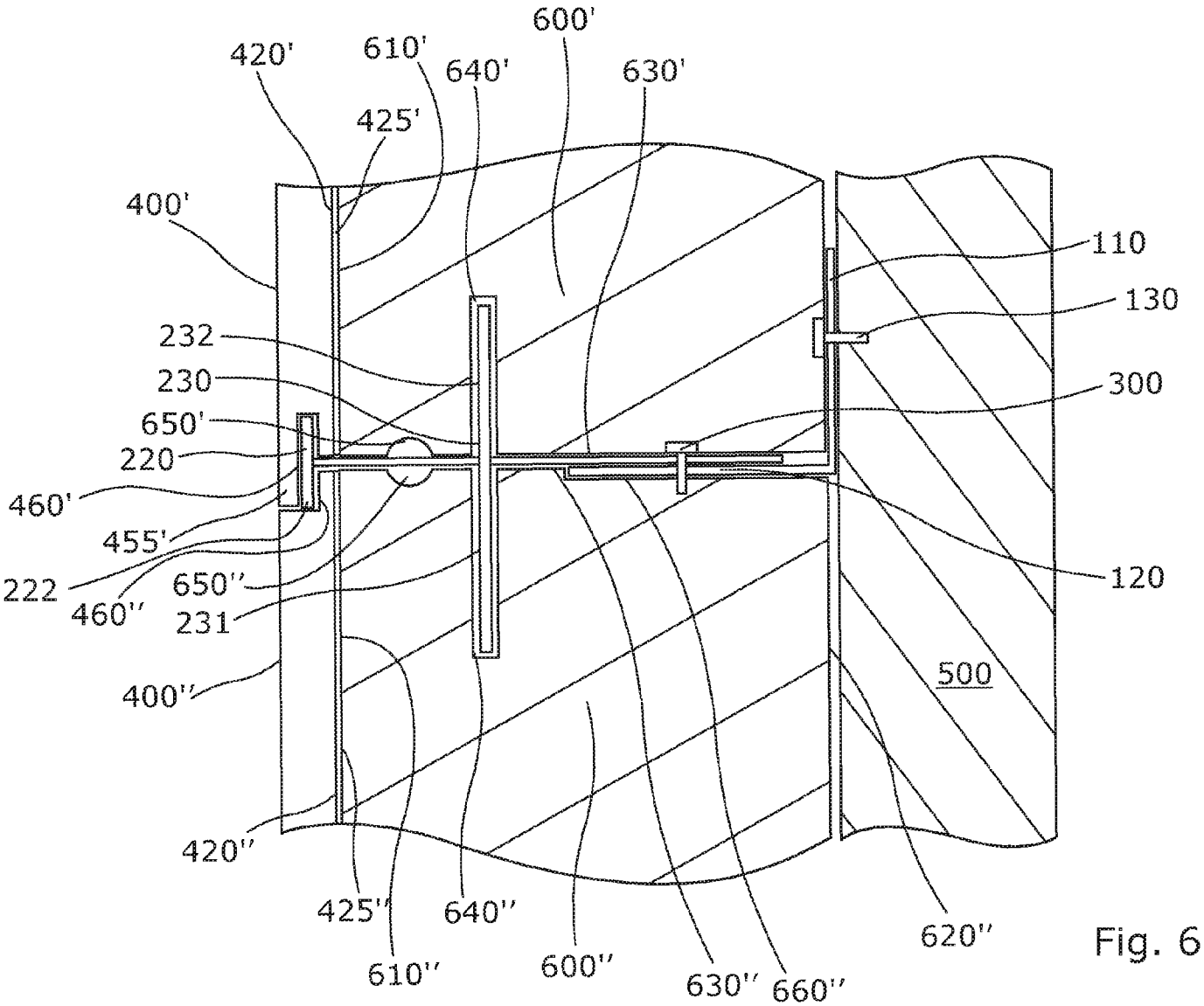
FIG. 6 is a cross sectional side view of an insulated wall section constructed according to certain embodiments of the present disclosure, using at least one adjustable building panel support device comprising a first panel retaining formation supporting and retaining each wall panel and a second panel retaining formation retaining and supporting an insulation layer integrally formed with each building panel, each insulation layer comprising at least one channel for providing a capillary break.

Referring now to FIG. 6, in some embodiments, insulating materials 600', 600" may include additional recesses 650', 650" configured to form one or more capillary breaks within the region between panels 400', 400" and the building surface 500. In some implementation, the capillary break may include a single recess (e.g., either 650' or 650"), or may include a recess 650', 650" of each insulation material 600', 600" located adjacently so as to provide a larger capillary break. Capillary break recesses 650' and 650" may be readily implemented in any of the insulated embodiments described herein, such as any of the embodiments described with reference to FIG. 5. The capillary break created by recesses 650' and 650" can at least partially trap water or other substances that may intrude between panels 400' and 400" to prevent such water or other substance from reaching the building surface 500. The capillary break created by recess 650', 650" may also advantageously facilitate the drainage of water or any other liquid that enters the region between panels 400', 400" and building surface 500, by providing a continuous fluid path parallel to the building surface to channel such liquid to a location where it can drain away from the building surface 500.

In this embodiment, second panel retaining formation 230 is spaced apart from first panel retaining formation 220 along plate section 210. Second panel retaining formation 230 is configured to provide a pair of flanges 231, 232 each extending substantially orthogonally from plate section 210, and each substantially parallel to first panel retaining formation 220. Second panel retaining formation 230 is engaged with first recess 640', 640" in side edge 630', 630" of substantially rigid insulating material 600', 600" for supporting and retaining panel 400', 400". Thus, the edges 630', 630" of insulating material sections 600', 600" may each include a recess 640', 640" sized and shaped to accommodate a flange of the second panel retaining formation 230. During installation, second panel retaining formation 230 can be engaged with first recess 640 within edge 630 of substantially rigid insulating material 600', 600" for supporting and retaining panel 400', 400". Thus, configurations of the building panel support device 010 including a first panel retaining formation 220 and a second panel retaining formation 230 may be used to provide a robust support structure for mounting insulated cladding panels to a building substrate. Similar to the embodiments described with reference to FIGS. 2B and 3B, the insulated embodiments described herein may be used with non-coplanar building substrates 500.

Similar to the panels 400', 400" depicted in FIG. 5, second pair of opposing side edges of panel 400', 400" optionally further comprise complementary overlapping profiles, such as a shiplap profile, so that, in use, the joint line between adjacent panels can be obscured and migration of water or other substances into or through the joints can be prevented or minimized. Third recess 660" in-side edge 630" of substantially rigid insulating material 600" may be provided to accommodate second portion 120 of support bracket 100. By providing third recess 660", support bracket 100 does not interfere with maintaining close stacking of adjacent panels 400', 400" and contact between insulation materials 600', 600" to prevent loss of thermal insulation performance because of thermal loss through gaps.

Figure 7C:
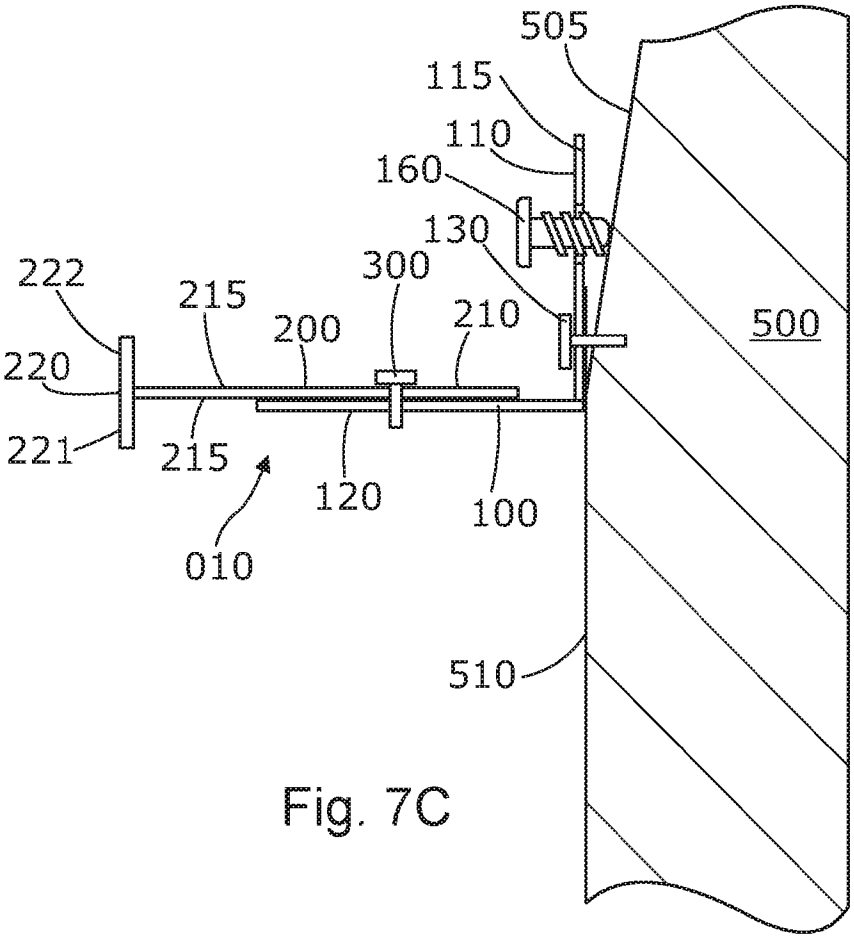
FIG. 7C is a cross sectional, section side view showing an embodiment of an adjustable building panel support bracket, showing the support bracket installed on a non-flat, non-level portion of substrate and the use of leveling screws to adjust the support bracket to a user defined orientation.
Figure 7A:
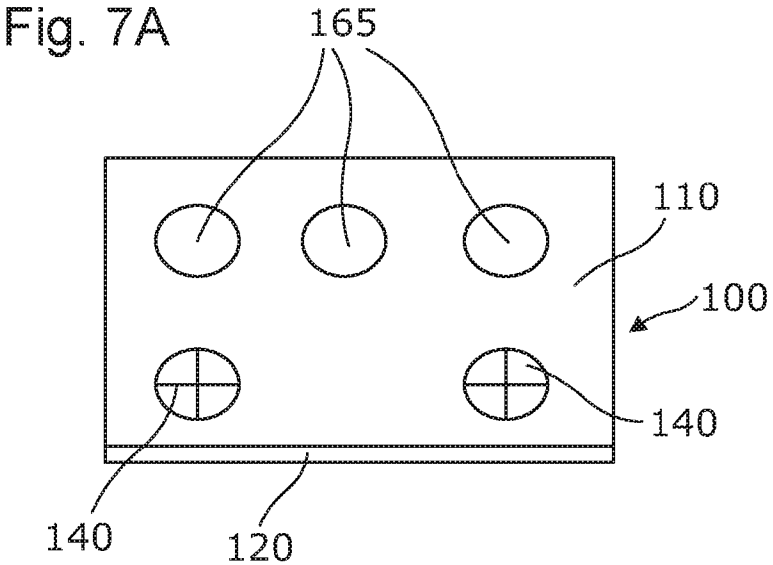
FIG. 7A is a front view of an embodiment of a support bracket, showing first fixing indicators and apertures.
Figure 7B:
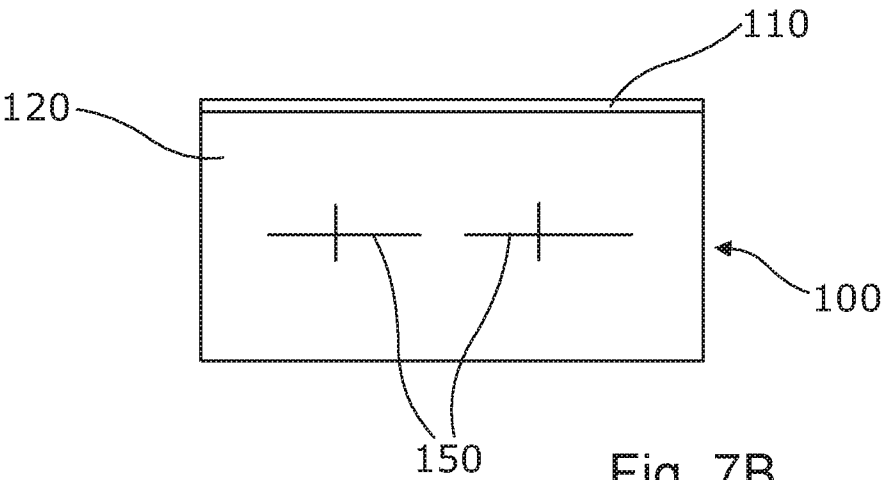
FIG. 7B is a top view of an embodiment of a support bracket, showing second fixing indicators.

As shown in FIGS. 7A-7C, adjustable building panel support device 010 may further comprise at least one aperture 165 in first portion 110, each aperture configured to accommodate a leveling means 160 such as a leveling screw. First portion 110 also comprises at least one first fixing indicia 140, for indicating positions at which portion 110 may be fixed to substrate 500 by at least one connector 130. FIG. 7B shows second fixing indicia 150 disposed on second portion 120 of support bracket 100 for indicating one or more general fixing locations to provide best load support characteristics in an "ideal" built system, although the skilled user would actually need to allow for variability resulting from substrate surface irregularities.

As shown in FIG. 7C, adjustable building panel support device 010 may further comprise leveling means 160, such as a leveling screw or the like, disposed on first portion 110 of support bracket 100 for adjusting the angle of second portion 120 of support bracket 100 relative to a reference surface such as an angled portion 505 of the surface of substrate 500, or to some external surface such as the ground. If adjustable building panel support device 010 is used to construct a wall section, generally second portion 120 of support bracket 100 would be adjustable via leveling means 160 to provide at least one flange 221, 222 of panel retaining formation 220 in a vertical orientation with respect to a flat, horizontal ground surface, and substantially orthogonal with respect to plate section 210.

Figure 8A:
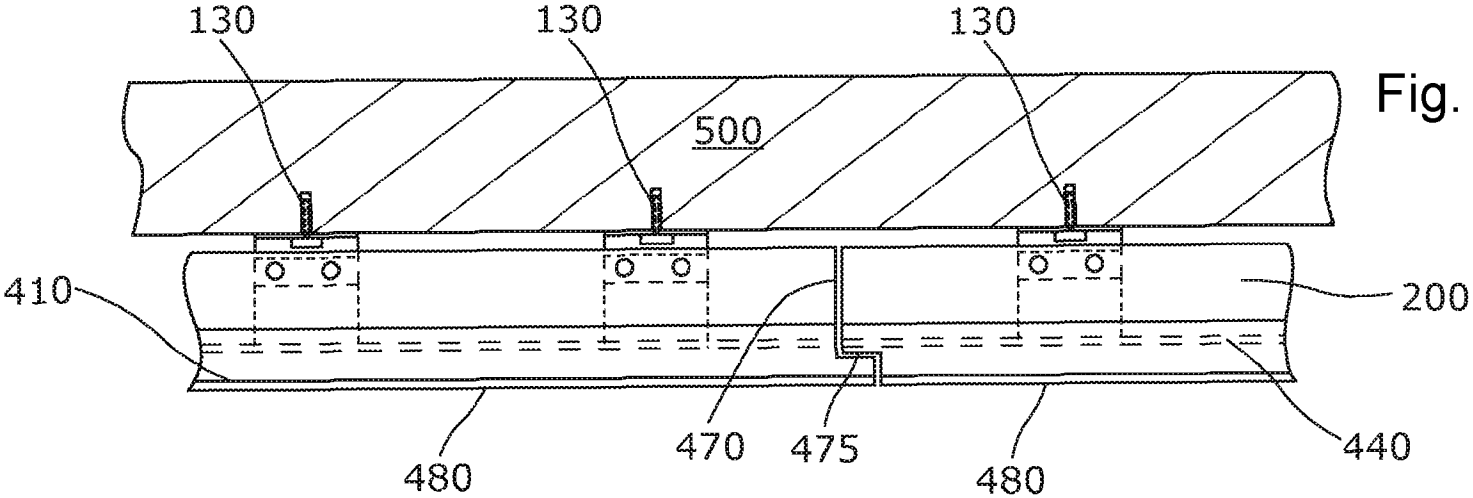
FIG. 8A shows a cross sectional, top view of a wall section constructed according to certain embodiments of the present disclosure.
Figure 8B:
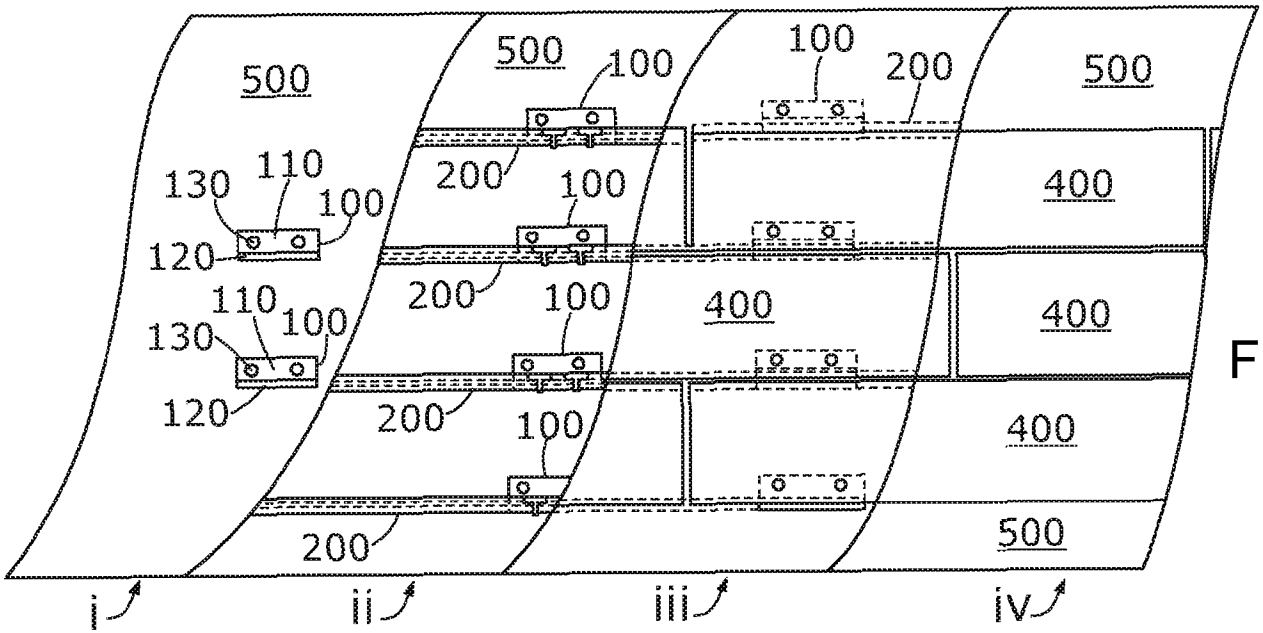
FIG. 8B shows sequential stages in the construction of a building wherein section according to certain embodiments of the present disclosure wherein section (i) shows an array of support brackets installed on a substrate, section (ii) shows a number of building panel support elements installed on respective support brackets, section (iii) shows building panels installed, but with the support brackets and panel support elements shown in broken lines, and section (iv) shows a portion of the finished constructed building section.

FIG. 8A shows a cross sectional top view of a wall section constructed according to one embodiment. FIG. 8B shows a sequence i-iv involved in a method of constructing the wall section of FIG. 8A, the method comprising the steps:

(a) providing a plurality of adjustable building panel support devices, each device comprising, a support bracket 100, a panel support element and at least one connector, (b) forming a user determined array of building panel support brackets fixed to a substrate 500 by sequentially bringing the substrate engaging surface of the first portion 110 of each support bracket 100 into contact with the building substrate 500, and fixing the first portion 110 of each support bracket 100 to substrate 500 at a user determined position using means 130, (c) bringing a face of the plate section of a first building panel support element 200 into contact with the second portion 120 of at least one support bracket 100, (d) positionally adjusting the building panel support element 200 relative to support bracket 100 to define a user determinable spacing between the first panel retaining formation and the substrate 500, (e) fixing plate section of building panel support element 200 and a corresponding second portion 120 of support bracket 100 together using at least one connector, (f) positioning at least one wall panel 400 so that first recess in first edge of a pair of opposing side edges of each building panel 400 is engaged by, and retained by, at least a first panel retaining formation, ensuring complementary edge profiles 475 on second pair of opposing side edges 470 of adjacent panels are fully engaged to provide best thermal and weather-tightness performance, (g) positioning at least a first panel retaining formation of a second building support element 200 so that it engages second recess of second edge of a respective pair of opposing side edges of another building panel and connecting its plate section to a respective support bracket 100 to support and retain building panel 400 in position, (h) repeating steps (f) and (g) until the desired section coverage is achieved, and (i) optionally, applying a decorative surface finish to first or external visible face of each panel 400.

A method of constructing an insulated wall section may include the steps:

(a) providing a plurality of adjustable building panel support devices and a plurality of insulated wall sections, each insulated wall section including a wall panel and an insulating material fixed to the wall panel, each panel support device comprising a support bracket, a connector, and a panel support element having a first support flange configured to engage and retain at least one wall panel and a second support flange configured to engage and retain at least one insulating material;

(b) forming a user determined array of support brackets fixed to a building substrate by bringing the support bracket of each building panel support device into contact with the building substrate and fixing each support bracket to the substrate at a user determined position;

(c) bringing the panel support element of at least one building panel support device into contact with the support bracket of the at least one building panel support device;

(d) positionally adjusting the panel support element of at least one building panel support device relative to the support bracket of the building panel support device to determine a user determinable spacing between the first flange and the building substrate;

(e) fixing the panel support element of the first building panel support device to the support bracket of the first building panel support device using at least one connector;

(f) positioning at least one insulated wall section so that the wall panel of the insulated wall section is engaged and retained by the first flange of at least a first building panel support device and the insulating material of the insulated wall section is engaged and retained by the second flange of the first building panel support device;

(g) positioning a panel support element of a second building panel support device so that it engages and retains the at least one insulated wall section;

(h) fixing the panel support element of the second building panel support device to the support bracket of the second building panel support device; and (i) repeating steps (f), (g), and (h) until a desired substrate coverage has been achieved.

It will be appreciated that the adjustable building panel support device enables construction of a building section by accommodating irregularities in a building substrate surface, in particular in construction of building sections fixed to a pre-existing substrate with an irregular surface.

Certain features that are described in this disclosure in the context of separate implementations can also be implemented in combination in a single implementation. Conversely, various features that are described in the context of a single implementation can also be implemented in multiple implementations separately or in any suitable subcombination. Moreover, although features may be described above as acting in certain combinations, one or more features from a claimed combination can, in some cases, be excised from the combination, and the combination may be claimed as any subcombination or variation of any subcombination.

Moreover, while methods may be depicted in the drawings or described in the specification in a particular order, such methods need not be performed in the particular order shown or in sequential order, and that all methods need not be performed, to achieve desirable results. Other methods that are not depicted or described can be incorporated in the example methods and processes. For example, one or more additional methods can be performed before, after, simultaneously, or between any of the described methods. Further, the methods may be rearranged or reordered in other implementations. Also, the separation of various system components in the implementations described above should not be understood as requiring such separation in all implementations, and it should be understood that the described components and systems can generally be integrated together in a single product or packaged into multiple products. Additionally, other implementations are within the scope of this disclosure.

Conditional language, such as "can," "could," "might," or "may," unless specifically stated otherwise, or otherwise understood within the context as used, is generally intended to convey that certain embodiments include or do not include, certain features, elements, and/or steps. Thus, such conditional language is not generally intended to imply that features, elements, and/or steps are in any way required for one or more embodiments.

Conjunctive language such as the phrase "at least one of X, Y, and Z," unless specifically stated otherwise, is otherwise understood with the context as used in general to convey that an item, term, etc. may be either X, Y, or Z. Thus, such conjunctive language is not generally intended to imply that certain embodiments require the presence of at least one of X, at least one of Y, and at least one of Z.

Language of degree used herein, such as the terms "approximately," "about," "generally," and "substantially" as used herein represent a value, amount, or characteristic close to the stated value, amount, or characteristic that still performs a desired function or achieves a desired result. For example, the terms "approximately", "about", "generally," and "substantially" may refer to an amount that is within less than or equal to 10% of, within less than or equal to 5% of, within less than or equal to 1% of, within less than or equal to 0.1% of, and within less than or equal to 0.01% of the stated amount.

Although making and using various embodiments are discussed in detail below, it should be appreciated that the description provides many inventive concepts that may be embodied in a wide variety of contexts. The specific aspects and embodiments discussed herein are merely illustrative of ways to make and use the systems and methods disclosed herein and do not limit the scope of the disclosure. The systems and methods described herein may be used for adjustable building panel support in wall construction and will be described hereinafter with reference to this application. However, it will be appreciated that the disclosure is not limited to this particular field of use.

Some embodiments have been described in connection with the accompanying drawings. The figures are drawn to scale, but such scale should not be limiting, since dimensions and proportions other than what are shown are contemplated and are within the scope of the disclosed inventions. Distances, angles, etc. are merely illustrative and do not necessarily bear an exact relationship to actual dimensions and layout of the devices illustrated. Components can be added, removed, and/or rearranged. Further, the disclosure herein of any particular feature, aspect, method, property, characteristic, quality, attribute, element, or the like in connection with various embodiments can be used in all other embodiments set forth herein. Additionally, it will be recognized that any methods described herein may be practiced using any device suitable for performing the recited steps.

While a number of embodiments and variations thereof have been described in detail, other modifications and methods of using the same will be apparent to those of skill in the art. Accordingly, it should be understood that various applications, modifications, materials, and substitutions can be made of equivalents without departing from the unique and inventive disclosure herein or the scope of the claims.

What is claimed is:

1. An insulated wall section comprising:

a building substrate;

at least one adjustable building panel support device fixed to the substrate, each adjustable building panel support device comprising:

a support bracket fixed to the building substrate; and a building panel support element comprising a plate section having a proximal portion and a distal end, a first support flange orthogonally intersecting the plate section at the distal end and configured to support and retain at least one building panel, and a second support flange orthogonally intersecting the plate section and configured to support and retain an insulating material, the second support flange intersecting the plate section at a location spaced between the proximal portion and the distal end, wherein the building panel support element is configured to be fixed to the support bracket at a user determined distance from the building substrate; and at least one insulated building panel, each insulated building panel comprising:

a wall panel comprising a first major surface, a second major surface parallel to the first major surface, and a pair of opposing edges, each opposing edge having a recess parallel to the first major surface and at least partially surrounding the first support flange; and an insulating material comprising a first face and a second face disposed at an angle relative to the first face, the first face being fixed to the second major surface of the wall panel, the second face having a support recess parallel to the first face and at least partially surrounding the second support flange.

2. The insulated wall section of claim 1, wherein a length of the first support flange in a direction orthogonal to the plate section is less than a length of the second support flange in the direction orthogonal to the plate section.

3. The insulated wall section of claim 1, wherein a length of the first support flange in a direction orthogonal to the plate section is greater than a width between the first major surface and the second major surface of each wall panel.

4. The insulated wall section of claim 1, wherein the support bracket comprises a first planar portion fixed to the building substrate and a second planar portion extending at an angle from the first planar portion, the second planar portion configured to support the building panel support element.

5. The insulated wall section of claim 1, wherein the building panel support element comprises a combination of a polymer and a metal.

6. The insulated wall section of claim 1, further comprising a chemical adhesive layer disposed between the first face of the insulating material and the second major surface of the wall panel, wherein the first face of the insulating material is fixed to the second major surface of the wall panel by the chemical adhesive layer.

7. The insulated wall section of claim 1, wherein the second face of the insulating material has a capillary break recess disposed between the first face and the support recess, the capillary break recess disposed parallel to the building substrate.

* * * * *